US011772398B2

(12) United States Patent
Zheng et al.

(10) Patent No.: US 11,772,398 B2
(45) Date of Patent: Oct. 3, 2023

(54) SYSTEMS AND APPARATUSES FOR AVOIDING RIBBON WRINKLE

(71) Applicant: Hand Held Products, Inc., Charlotte, NC (US)

(72) Inventors: Hao Zheng, Singapore (SG); Jennelyn Requinto, Singapore (SG); Teng Beng Low, Singapore (SG); Rizam Bin Ramli, Singapore (SG)

(73) Assignee: HAND HELD PRODUCTS, INC., Charlotte, NC (US)

( * ) Notice: Subject to any disclaimer, the term of this patent is extended or adjusted under 35 U.S.C. 154(b) by 53 days.

(21) Appl. No.: 17/189,223

(22) Filed: Mar. 1, 2021

(65) Prior Publication Data

US 2022/0274431 A1 Sep. 1, 2022

(51) Int. Cl.
*B41J 33/14* (2006.01)
*B41J 35/08* (2006.01)

(52) U.S. Cl.
CPC ..... *B41J 33/14* (2013.01); *B41J 35/08* (2013.01)

(58) Field of Classification Search
None
See application file for complete search history.

(56) References Cited

U.S. PATENT DOCUMENTS 2,474,717 A * 6/1949 Belcher ..... D06B 3/10 26/18.6
5,128,763 A * 7/1992 Sakuragi ..... H04N 1/00543 400/208
5,342,131 A * 8/1994 Nakajima ..... B41J 17/24 347/217
6,840,689 B2 1/2005 Barrus et al.
2005/0195270 A1* 9/2005 Shih ..... B41J 35/08 347/217

FOREIGN PATENT DOCUMENTS

CN 106183448 B 9/2018
KR 2008-0014945 A 2/2008

OTHER PUBLICATIONS

"Video: Loading the Ribbon and Resolving Ribbon Issues on 105SL | Zebra." Zebra Technologies, www.zebra.com/us/en/support-downloads/knowledge-articles/ait/105sl-printer-loading-the-ribbon-and-resolving-ribbon-issues-with-video.html. Accessed Jun. 8, 2021.

* cited by examiner

*Primary Examiner* — Matthew G Marini
(74) *Attorney, Agent, or Firm* — Alston & Bird LLP

(57) ABSTRACT

Various embodiments disclose a printing apparatus. The apparatus includes a ribbon supply spool configured to facilitate traversal of ribbon along a ribbon conveyance path. Further, the apparatus includes a ribbon take-up spool positioned downstream of the ribbon supply spool along the ribbon conveyance path configured to receive the ribbon after a printing operation. Further, the apparatus includes a ribbon support plate positioned in the ribbon conveyance path between the ribbon supply spool and the ribbon take-up spindle, wherein the ribbon support plate includes a plurality of protruding segments extending along the ribbon conveyance path, wherein the plurality of protruding segments facilitates stretching of the ribbon as the ribbon traverses along the ribbon conveyance path.

16 Claims, 8 Drawing Sheets

SYSTEMS AND APPARATUSES FOR AVOIDING RIBBON WRINKLE

TECHNOLOGICAL FIELD

Exemplary embodiments of the present disclosure relate generally to printers and, more particularly, to systems and apparatuses to avoid wrinkling of ribbon in printers.

BACKGROUND

Printing systems, such as copiers, printers, facsimile devices or other systems, may be capable of reproducing content, visual images, graphics, texts, etc. on a page or a media. Some examples of the printing systems may include, but not limited to, thermal printers, inkjet printers, laser printers, and/or the like.

A typical thermal printer includes a thermal print head that has one or more heating elements. These heating elements may be individually or collectively energized to perform the printing operation. Examples of the thermal printers may include thermal transfer printers and direct thermal printers. Typically, in thermal transfer printer, content is printed on the media by heating a coating of a ribbon so that the coating is transferred to the media. It contrasts with the direct thermal printing where no ribbon is present in the process.

SUMMARY

Exemplary embodiments of the present disclosure relate generally to a printer.

Various embodiments described herein illustrate an apparatus for a ribbon supply spool configured to facilitate traversal of ribbon along a ribbon conveyance path. The apparatus comprises a ribbon take-up spool positioned downstream of the ribbon supply spool along the ribbon conveyance path configured to receive the ribbon after a printing operation. The apparatus further comprises a ribbon support plate positioned in the ribbon conveyance path between the ribbon supply spool and the ribbon take-up spindle. The ribbon support plate includes a plurality of protruding segments extending along the ribbon conveyance path, wherein the plurality of protruding segments facilitates stretching of the ribbon as the ribbon traverses along the ribbon conveyance path.

BRIEF DESCRIPTION OF THE DRAWINGS

The description of the illustrative embodiments can be read in conjunction with the accompanying figures. It will be appreciated that for simplicity and clarity of illustration, elements illustrated in the figures have not necessarily been drawn to scale. For example, the dimensions of some of the elements are exaggerated relative to other elements. Embodiments incorporating teachings of the present disclosure are shown and described with respect to the figures presented herein, in which.

DETAILED DESCRIPTION

Figure 1A:
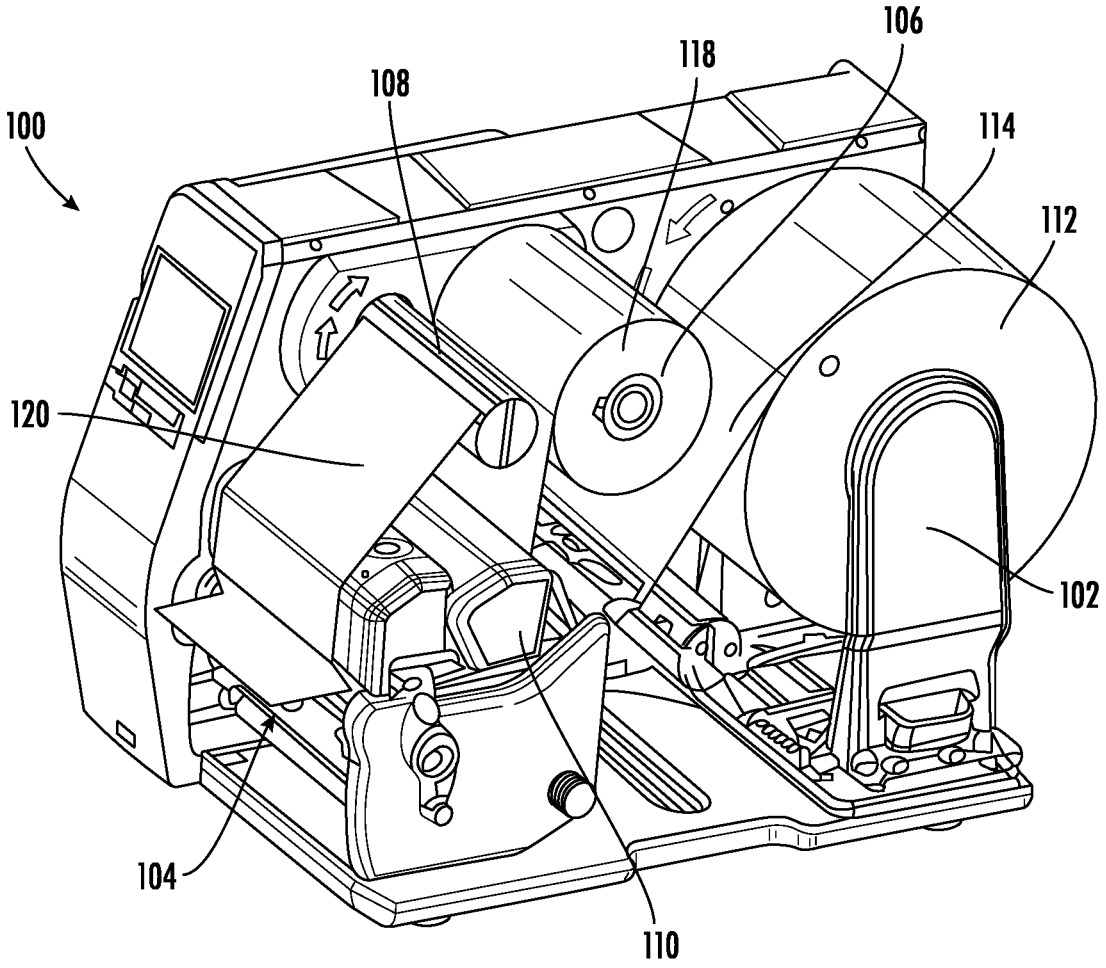
FIGS. 1A, 1B, and 1C illustrate a perspective view of a printer, according to one or more embodiments described herein.

Some embodiments of the present disclosure will now be described more fully hereinafter with reference to the accompanying drawings, in which some, but not all embodiments of the disclosure are shown. Indeed, these disclosures may be embodied in many different forms and should not be construed as limited to the embodiments set forth herein; rather, these embodiments are provided so that this disclosure will satisfy applicable legal requirements. Like numbers refer to like elements throughout. Terminology used in this patent is not meant to be limiting insofar as devices described herein, or portions thereof, may be attached or utilized in other orientations The term "comprising" means including but not limited to and should be interpreted in the manner it is typically used in the patent context. Use of broader terms such as comprises, includes, and having should be understood to provide support for narrower terms such as consisting of, consisting essentially of, and comprised substantially of.

The phrases "in one embodiment," "according to one embodiment," and the like generally mean that the particular feature, structure, or characteristic following the phrase may be included in at least one embodiment of the present disclosure, and may be included in more than one embodiment of the present disclosure (importantly, such phrases do not necessarily refer to the same embodiment)

The word "exemplary" is used herein to mean "serving as an example, instance, or illustration." Any implementation described herein as "exemplary" is not necessarily to be construed as preferred or advantageous over other implementations.

If the specification states a component or feature "may," "can," "could," "should," "would," "preferably," "possibly," "typically," "optionally," "for example," "often," or "might" (or other such language) be included or have a characteristic, that particular component or feature is not required to be included or to have the characteristic. Such component or feature may be optionally included in some embodiments, or it may be excluded.

The word "media" is used herein to mean a printable medium, such as a page or paper, on which content, such as graphics, text, and/or visual images, may be printable. In some embodiments, the media may correspond to a thermal media on which the content is printed on application of heat on the media itself or the media may correspond to a liner media, a liner-less media, and/or the like. The media may correspond to a continuous media that may be loaded in the printer in form of a roll or a stack or may correspond to media that may be divided into one or more portions through perforations defined along a width of the media. Alternatively, or additionally, the media may be divided into the one or more portions through one or more marks that are defined at a predetermined distance from each other, along the length of the media. In some example embodiments, a contiguous stretch of the media, between two consecutive marks or two consecutive perforations, corresponds to a portion of the media.

Figure 1B:
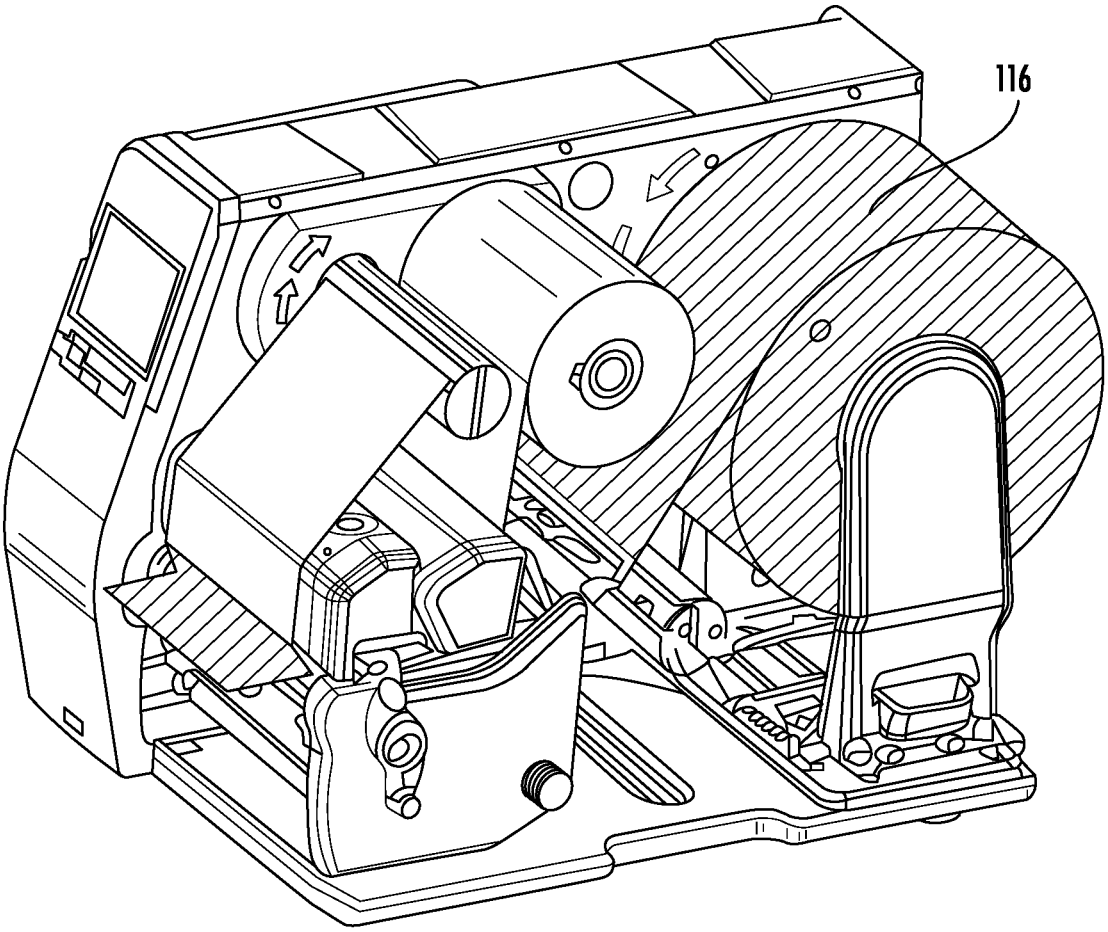
Figure 1C:
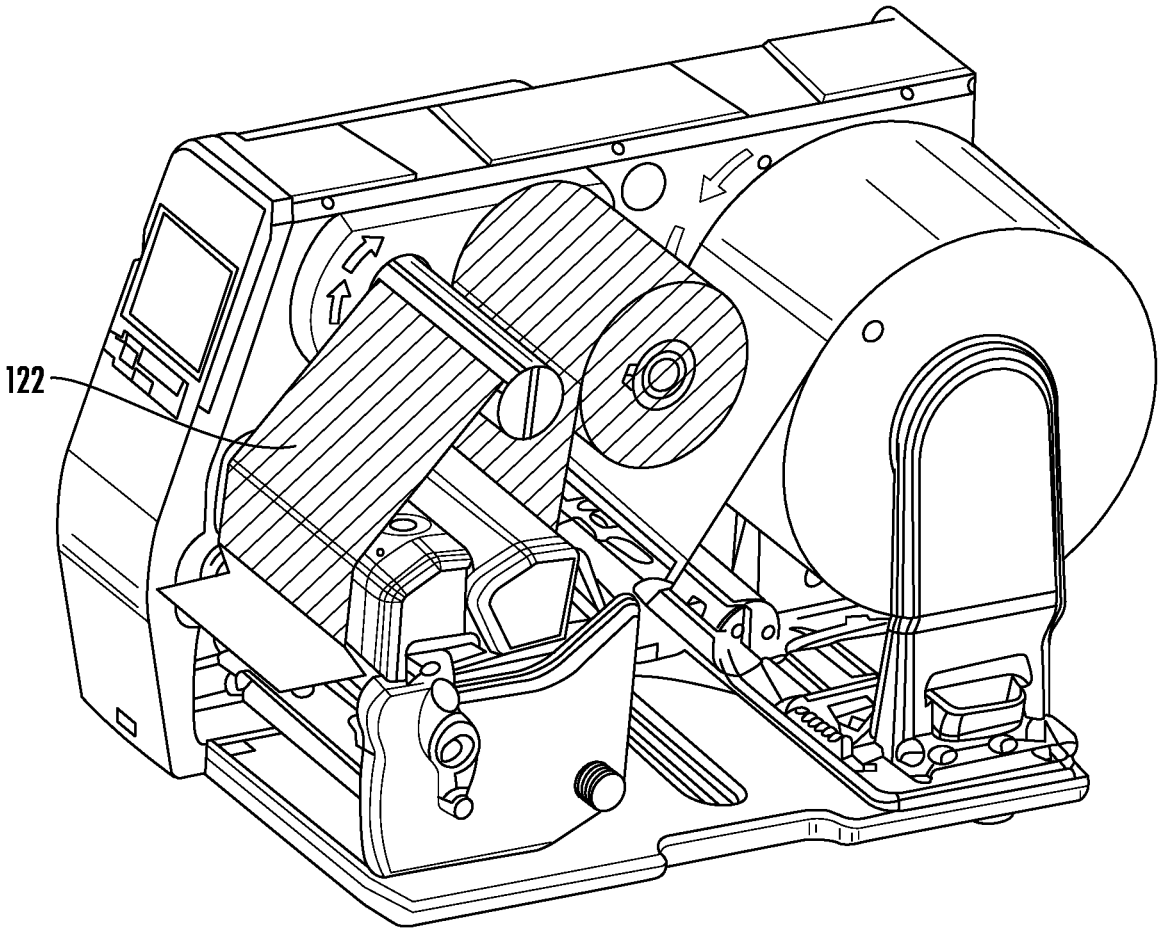

FIGS. 1A, 1B, and 1C illustrate a perspective view of a printer 100, according to one or more embodiments described herein. The printer 100 may include a media hub 102, a printer media output 104, a ribbon drive assembly 106, a ribbon take-up hub 108, and a print head 110.

In an example embodiment, the media hub 102 is configured to receive a media roll 112. In an example embodiment, the media roll 112 may correspond to a roll of a media 114 that may be a continuous media or may, in some example embodiments, include one or more portions that are defined (in the media 114) by means of perforations or one or more marks. In an example embodiment, the media hub 102 is coupled to a first electrical drive (not shown) that actuates the media hub 102. On actuation, the media hub 102 causes the media roll 112 to rotate, which further causes the media roll 112 to supply the media 114 to the print head 110 along a media path 116 (shaded in FIG. 1B). In an example embodiment, along the media path 116, the media 114 traverses from the media roll 112 through the print head 110 to the printer media output 104.

In an example embodiment, the printer media output 104 corresponds to a slot through which the printed media is outputted. The width of the printer media output 104 is in accordance with a width of the media 114. In some examples, the width of the printer media output 104 may correspond to a maximum width of the media 114 supported by the printer 100.

The ribbon drive assembly 106 may receive a ribbon roll 118 that corresponds to a roll of a ribbon 120. In an example embodiment, the ribbon 120 may correspond to an ink media that is utilized to dispose ink onto the media 114 to print content on the media 114. In an example embodiment, the ribbon drive assembly 106 may be coupled to a second electrical drive that may be configured to actuate the ribbon drive assembly 106. On actuation of the ribbon drive assembly 106, the ribbon drive assembly 106 rotates, which in turn causes the ribbon roll to rotate that causes the ribbon roll 118 to supply the ribbon 120 along a ribbon conveyance path 122 (shaded in FIG. 1C). Along the ribbon conveyance path 122, the ribbon 120 traverses from the ribbon roll 118 to the print head 110 and further to the ribbon take-up hub 108.

In an example embodiment, the ribbon take-up hub 108 may correspond to an assembly that may receive used ribbon (i.e., a section of the ribbon 120 from which the ink has been is disposed on the media 114). The ribbon take-up hub 108 may also be coupled to a third electrical drive that may be configured to actuate the ribbon take-up hub 108. On actuation, the ribbon take-up hub 108 pulls the ribbon 120 from the ribbon roll 118. In some examples, the second electrical drive and the third electrical drive may operate in synchronization such that an amount of ribbon 120 released by the ribbon roll 118 (due to actuation of the second electrical drive) is equal to the amount of ribbon 120 received by the ribbon take-up hub 108.

The print head 110 may correspond to a component that is configured to print the content on the media 114. In an example embodiment, the print head 110 may include a plurality of heating elements (not shown) that are energized and pressed against the ribbon 120 to perform a print operation. In operation, the print head 110 applies heat on a portion of the ribbon 120 and, concurrently, presses the ribbon 120 against the media 114 to transfer the ink on the media 114. In an example scenario where the media 114 corresponds to thermal paper, the print head 110 may be directly press against the thermal paper to perform the print operation.

During the print operation, one or more heating elements of the plurality of heating elements are energized to perform the print operation. The one or more heating elements may be selected based on the data in a print job. For example, if a letter "A" is to be printed, the one or more heating elements that are energized are positioned on the print head 110 in such a manner that when the print head 110 is pressed against the ribbon 120 and the media 114, letter "A" gets printed on the media 114. To press the ribbon 120 against the media 114, the print head 110 translates in a vertically downward direction (or downward direction) to push the ribbon 120 against the media 114.

In an example embodiment, after the print operation, the media 114 and the ribbon 120 traverse along the media path 116 and the ribbon conveyance path 122, respectively, such that the printed media is outputted from the printer media output 104 and the used ribbon traverses to the ribbon take-up hub 108.

Figure 2:
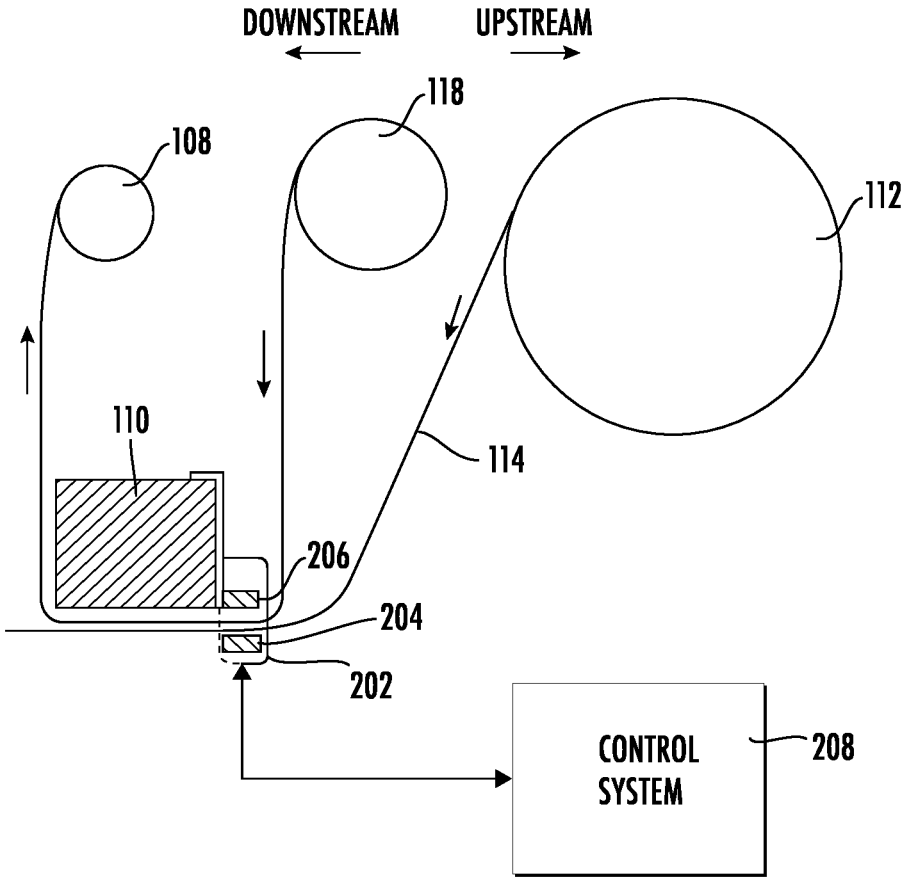
FIG. 2 illustrates a schematic of the printer, according to one or more embodiments described herein.

FIG. 2 illustrates a schematic of the printer 100, according to one or more embodiments described herein. The schematic of the printer 100 further depicts the media path 116, and the ribbon conveyance path 122. Furthermore, the schematic of the printer 100 depicts that the print head 110 is positioned downstream of the media roll 112 along the media path 116, and downstream of the ribbon roll 118 along the ribbon conveyance path 122.

In an example embodiment, the print head 110 is positioned on top of both the ribbon conveyance path 122 and the media path 116. Further, the ribbon conveyance path 122 is proximate to the print head 110 in comparison to the media path 116. Therefore, the ribbon 120 is proximate to the print head 110, in comparison to the media 114, and is therefore, positioned above the media 114. During the print operation, the print head 110 moves in a vertically downward direction to press the ribbon 120 against the media 114 to perform the print operation.

The media sensor 202 may correspond to a sensor that is configured to detect a presence of the media 114 on the media path 116. In some example embodiments, the media sensor 202 may be configured to detect the presence of the media 114 by determining transmissivity and/or reflectivity of the media 114. In an example embodiment, the transmissivity of the media 114 may correspond to a measure of an intensity of a light signal that media 114 allows to pass through it. In an example embodiment, the reflectivity of the media 114 may corresponds to a measure of an intensity of light signal that gets reflected from a surface of the media 114.

FIGS. 1A, 1B, and 1C depict the printer 100 as the industrial type of thermal transfer printer. However, in some embodiments, the scope of the disclosure is not limited to the printer 100 being an industrial type of thermal transfer printer. In alternate embodiments, the printer 100 may correspond to a desktop type thermal transfer printer, as is further described in conjunction with FIG. 3.

Figure 3:
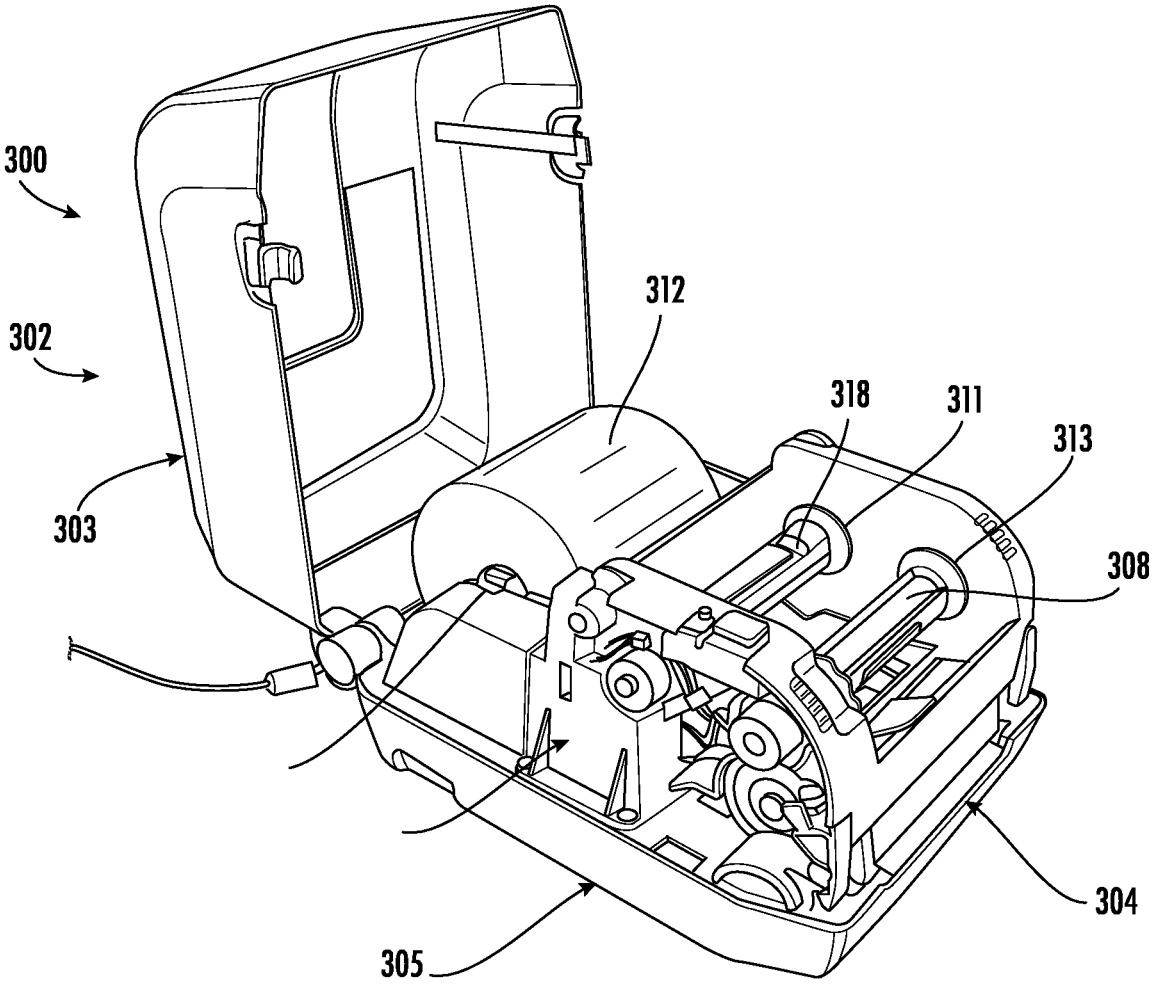
FIG. 3 illustrates a perspective view and a schematic of an example desktop type thermal transfer printer, respectively, according to one or more embodiments described herein.

FIG. 3 illustrates a perspective view and a schematic of an example desktop type thermal transfer printer 300, respectively, according to one or more embodiments described herein.

Referring to FIG. 3, the thermal printer 300 includes a housing 302 that includes a top cover 303, a main body 305, and a frame 307. The top cover 303 is pivotally coupled to the main body 305. The main body is further configured to receive the frame 307. In some examples, the frame 307 defines one or more holders and/or features that enable the main body 305 of the thermal transfer printer 300 to receive a media roll 312, a ribbon supply spool 318 operable for supplying a ribbon, a print station (not shown) having a printhead (not shown), and a ribbon take-up spool 308. For example, the frame 307 defines a media roll holder 309, a ribbon supply holder 311, and ribbon take-up holder 313. The media roll holder 309, the ribbon supply holder 311, and the ribbon take-up holder 313 are configured to receive media roll 312, the ribbon supply spool 318, and the ribbon take-up spool 308, respectively. The structure of the frame 307 is further described in conjunction with FIG. 4.

Those skilled in the art will appreciate that many other components may be included within the printer and many configurations may be employed. In all exemplary embodiments, during a printing operation, the media 114 is fed from the media roll 312 and the ribbon 120 is fed from the ribbon supply spool 318 to the print station for printing and then the ribbon 120 is wound up by the ribbon take-up spool 308 while the media 114 exits from the print station as printed media 304. In an example embodiment, the printing of content on the media 114 includes melting ink (disposed on the ribbon 120 and pressing the ribbon 120 (with the melted ink) on the media 114 to print content. The printhead 110 contains selectively energizable heating elements that enable melting of a portion of the ink on the ribbon 120 for transferring on the media 114.

In some examples, each of the ribbon supply spool 318, and the ribbon take-up roll 308 can be provided with an independently operated drive system comprising a plurality of gears for rotating the spools, a motor (not shown) for driving the plurality of gears respectively, in both a clockwise or counter clockwise direction, and a rotary encoder (not shown). In exemplary embodiments, the drive system can be connected to the base plate (not shown). It will be understood by those skilled in the art that it is contemplated that the motor will be a DC or stepper motor, however, any type of motor suitable for powering the gears and the ribbon supply spool 318 and the ribbon take-up spool 308 in a rotary movement may be employed. Further, in alternative exemplary embodiments, the motors are independently operated. For the purpose of ongoing description, the various embodiments of the present disclosure have been described in view of the printer 100. However, the embodiments described herein are also applicable of the desktop type thermal printer 300, without departing from the scope of the disclosure.

Figure 4:
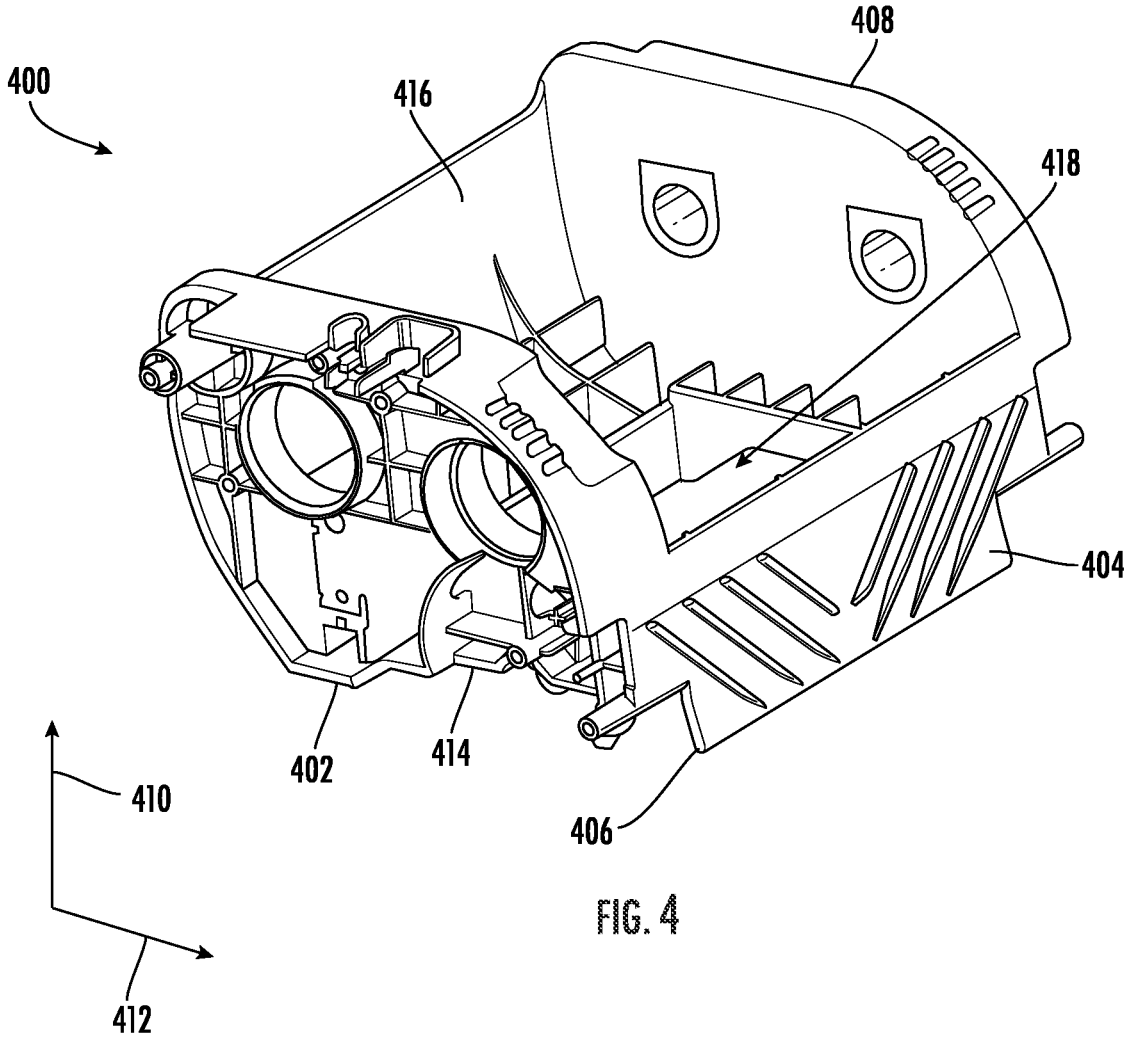
FIG. 4 illustrates a perspective view of a portion of the frame, according to one or more embodiments described herein.

FIG. 4 illustrates a perspective view of a portion 400 of the frame 307, according to one or more embodiments described herein. The portion 400 of the frame 307 defines one or more surfaces and/or plates that in conjunction defines the ribbon conveyance path 122. For example, the portion 400 of the frame 307 defines a surface 402 and a ribbon support plate 404. The surface 402 may proximal to a bottom edge 406 of the frame 307. In some examples, the bottom edge 406 of the frame 307 may be configured to be received within the main body 305 of the thermal printer 300. Additionally, the surface 402 may be defined to be distal from the top edge 408 of the frame 307. In an example embodiment, the top edge 408 and the bottom edge 406 of the frame 307 may be spaced apart from each other along a vertical axis 410 of the frame 307. In some examples, the vertical axis 410 may be orthogonal to the lateral axis 412 of the frame 307. In some examples, the vertical axis 410 may correspond to the vertical axis of the printing apparatus 100.

In an example embodiment, the surface 402 may constitute a bottom surface 414 of the frame 307. The bottom surface 414 of the frame 307 may define a through hole 418 that may extend from the bottom surface 414 of the frame 307 to an inner surface 416 of the frame 307. The through hole 418 may be configured to receive print station (not shown). As discussed, the print station includes a thermal print head that is configured to perform the printing operation. In some examples, the through hole 418 is downstream of the surface 402 along the lateral axis 412 of the frame 307.

Additionally, or alternatively, the frame 307 defines the ribbon support plate 404 that is positioned downstream of the surface 402 and the through hole 418 along the lateral axis 412. In an example embodiment, the ribbon support plate 404 is molded with the frame 307. Additionally, the ribbon support plate 404 may extend from the bottom edge 406 of the frame towards the top edge 408 of the frame 307, along the vertical axis 410 of the frame 307. The structure of the ribbon support plate 404 is further described in conjunction with FIGS. 5-6.

In some examples, the surface 402, the through hole 418 and the ribbon support plate 404 in conjunction may define the ribbon conveyance path 122. For example, the ribbon supply spool 318 may be configured to supply the ribbon 120 towards the surface 402 along the vertical axis 410 of the frame 307. From the surface 402 of the frame 307, the ribbon may traverse towards the through hole 418, along the lateral axis 412, where the print station may heat the ribbon to print content on the media 114. After the print operation, the ribbon 120 may be caused to traverse along the vertical axis 410 towards the ribbon take-up spool 308. During the traversal of the ribbon 120 towards the ribbon take-up spool 308, the ribbon 120 may abut the outer surface of ribbon support plate 404. In an example embodiment, the ribbon support plate 404 may facilitate removal of the wrinkles on the ribbon 120.

Figure 5:
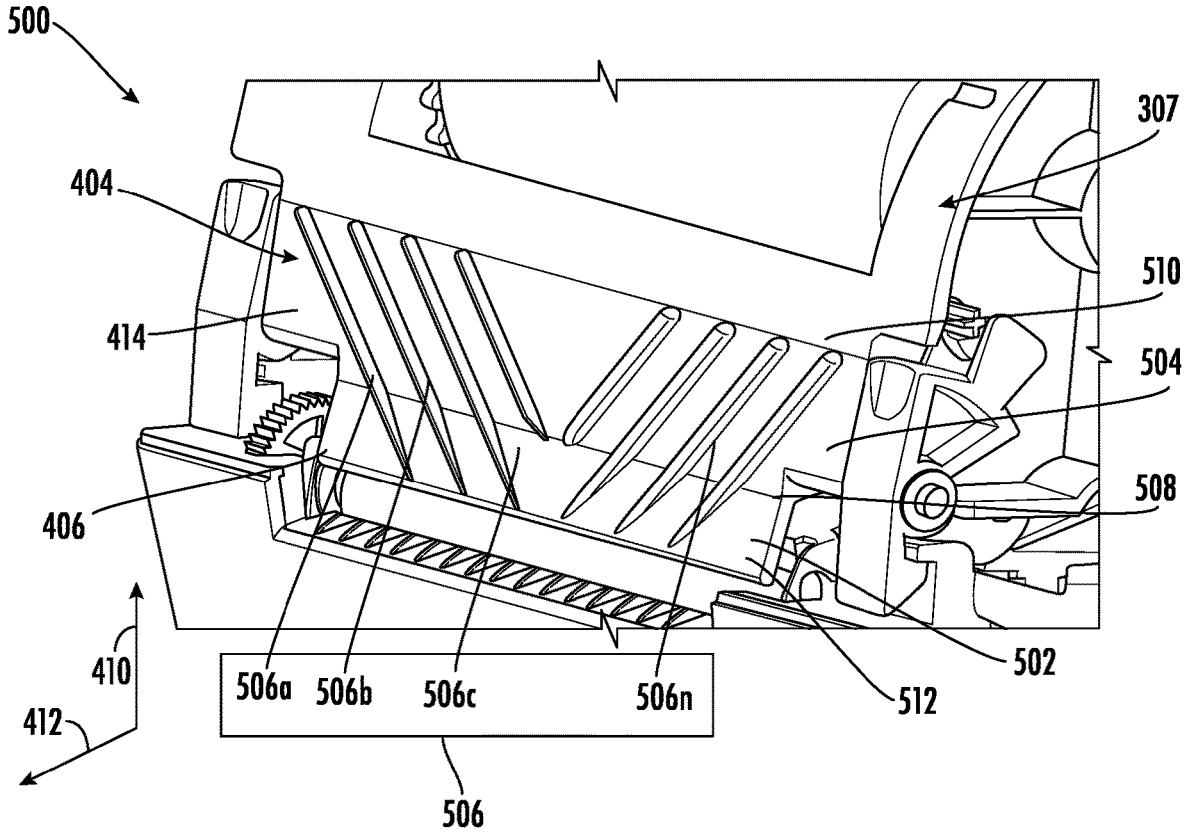
FIG. 5 illustrates a perspective view of another portion of the frame, according to one or more embodiments described herein.

In some examples, the scope of the disclosure is not limited to the ribbon support plate 404 to extend along the vertical axis 410 of the frame 307. In an example embodiment, the ribbon support plate 404 may extend along the vertical axis 410 such that the ribbon support plate 404 may be inclined at a predetermined angle with respect to the vertical axis 410. In some examples, the predetermined angle between the ribbon support plate 404 and the vertical axis 410 may correspond to a positive angle, as measured from the vertical axis. Accordingly, the ribbon support plate 404 may extend inwardly in the frame 307, along the ribbon conveyance path 122 from the through hole 418 towards the ribbon take-up spool 308. Such inclination of the ribbon support plate 404 facilitates maintaining tension in the ribbon 120, as the ribbon traverses along the ribbon conveyance path 122. In some examples, the scope of the disclosure is not limited to the complete ribbon support plate 404 to be inclined with respect to the vertical axis 410. In some examples, only a portion of the ribbon support plate 404 may be inclined with respect to the vertical axis 410. In other words, in various embodiments, ribbon support plate 404 is position downstream of the print head in the print station and upstream of the ribbon take-up spool 308 so as to cause the ribbon 120 to abut at least a portion the surface of ribbon support plate 404 that comprises protruded segments 506 (Ref. FIG. 5).

FIG. 5 illustrates a perspective view of another portion 500 of the frame 307, according to one or more embodiments described herein. The other portion 500 of the frame 307 illustrates a perspective view of the ribbon support plate 404. In an example embodiment, the ribbon support plate 404 includes a print station proximal portion 502, a print station distal portion 504, a plurality of protruding segments 506*a*, 506*b*, . . . 506*n* (hereinafter referred to as protruding segments 506).

In an example embodiment, the print station proximal portion 502 may extend from the bottom edge 406 of the frame 307 to a junction 508 between the print station proximal portion 502 and the print station distal portion 504, along the vertical axis 410 of the frame 307. Further, the print station distal portion 504 may extend from the junction 508 to a top edge 510 of the ribbon support plate 404, along the vertical axis 410. In some examples, the print station proximal portion 502 and the print station distal portion 504 may be aligned on a same plane extending along the vertical axis 410 of the frame 307. In an alternative embodiment, the print station proximal portion 502, and the print station distal portion 504 may extend along different planes along the vertical axis 410 of the frame. For example, the print station proximal portion 502 may be inclined at the predetermined angle with respect to vertical axis 410 of the frame 307 such that the print station proximal portion 502 may extend inwardly within the frame 307 as observed from the bottom edge 406 of the frame 307. Additionally, or alternately, the print station distal portion 504 may extend along the vertical axis 410 of the frame 307. To this end, the print station distal portion 504 may create a 0 degrees angle with respect to the vertical axis 410 of the frame 307. In another example, the print station distal portion 504 may also be inclined at a second predetermined angle with respect to the vertical axis 410. In such an example, a measure of the predetermined angle between the vertical axis 410 and the print station proximal portion 502, is less than a measure of the second predetermined angle between the vertical axis 410 and the print station distal portion 504.

In an alternative embodiment, the print station proximal portion 502 may be inclined at the predetermined angle with respect to vertical axis 410 of the frame 307 such that the print station proximal portion 502 may extend outwardly from the frame 307 as observed from the bottom edge 406 of the frame 307.

In an example embodiment, the print station proximal portion 502 and the print station distal portion 504 may define a base surface 512 of the ribbon support plate 404. In an example embodiment, the base surface 512 may correspond contiguous surface of the ribbon support plate 404. In some examples, the base surface 512 of the ribbon support plate 404 may define the protruding segments 506. In an example embodiment, the protruding segments 506 may extend between the bottom edge 406 and top edge 510 of the ribbon support plate 404 along the vertical axis 410 of the frame 307. The structure of the protruding segments 506 is further described in conjunction with FIG. 6A, FIG. 6B, and FIG. 6C.

Figures 6A, 6B, 6C:
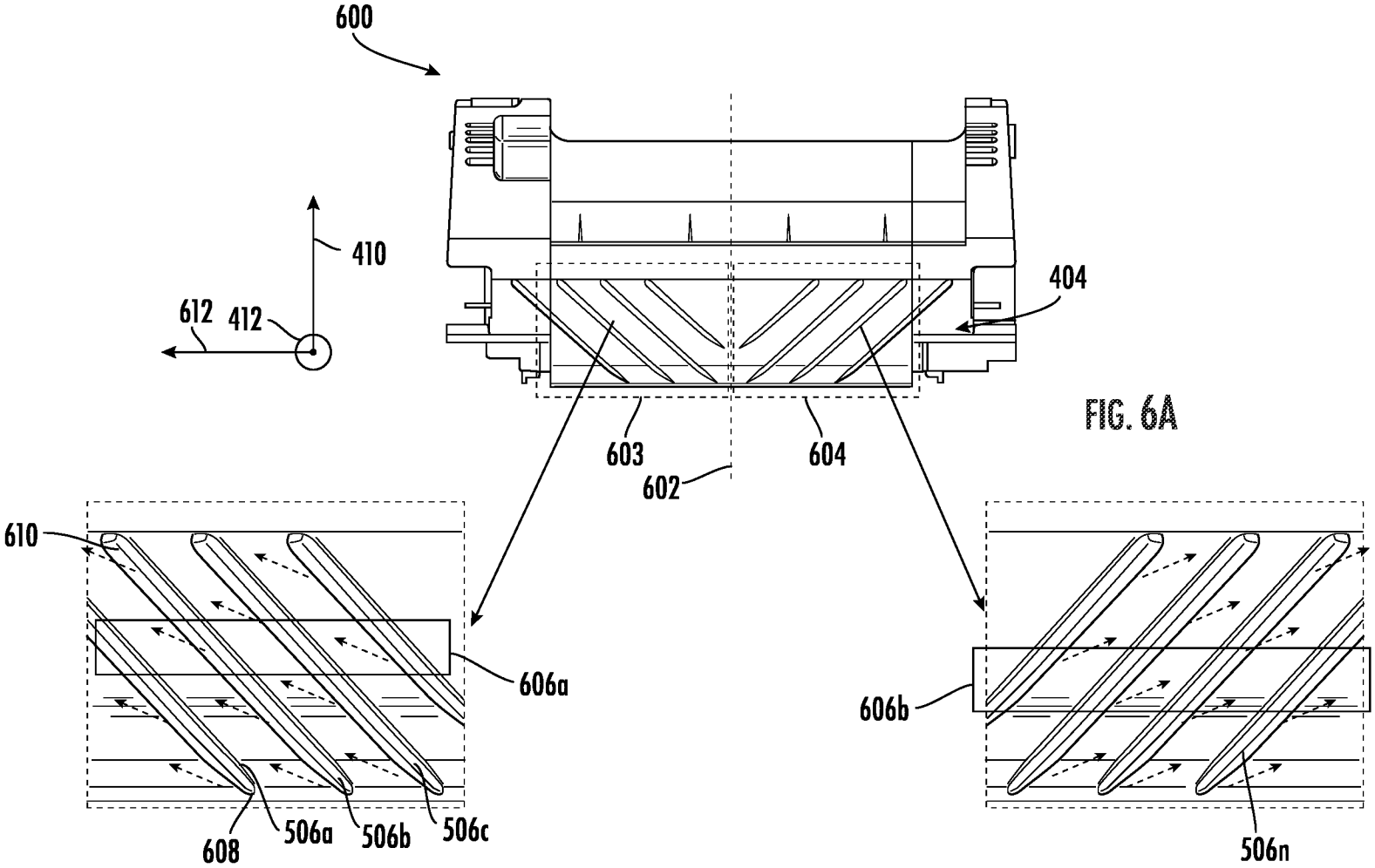
FIG. 6A illustrate a front view of the ribbon support plate, according to one or more embodiments described herein.
FIG. 6B, illustrates a front view of the first lateral portion of the ribbon support plate, according to one or more embodiments described herein.
FIG. 6C, illustrates a front view of the second lateral portion of the ribbon support plate, according to one or more embodiments described herein.

FIG. 6A illustrate a front view 600 of the ribbon support plate 404, according to one or more embodiments described herein. The front view 600 of the ribbon support plate 404 illustrates a median 602, that extends along the vertical axis 410 of the frame 307, of the ribbon support plate 404 that divides the ribbon support plate 404 into a first lateral portion 603 and a second lateral portion 604. The first lateral portion 603 and the second lateral portion 604 of the ribbon support plate 404 includes a set of protruding segments 606*a* and 606*b*, respectively. The first lateral portion 603 and the second lateral portion 604 are further illustrated in FIG. 6B and FIG. 6C, respectively.

FIG. 6B, illustrates a front view of the first lateral portion 603 of the ribbon support plate 404, according to one or more embodiments described herein. The first lateral portion 603 includes the set of protruding segments 606*a*. A protruding segment 506*a* in the set of protruding segments 606*a* includes a first end 608 and a second end 610. The first end 608 and the second end 610 may be spaced apart from along the vertical axis 410 of the frame 307. Further, the first end 608 may defined proximal to the bottom edge 406 of the frame 307. Further, the second end 610 is defined to be positioned proximal to the top edge 510 of the ribbon support plate 404. Additionally, or alternately, a width of the first end 608, along a longitudinal axis 612 of the frame 307, is less than a width of the second end 610, along the longitudinal axis 612 of the frame 307. Accordingly, a width of the protruding segment 506*a*, along the longitudinal axis 612 of the frame 307, increases along the ribbon conveyance path 122 towards the second end 610 of the protruding segment 506*a*. In an alternative embodiment, the width of the protruding segment 506*a*, along the longitudinal axis 612 of the frame 307, increases between the first end of the protruding segment 506*a* and the junction 508 between the print station proximal portion 502 and the print station distal portion 504. Thereafter, the width of the protruding segment 506*a*, along the longitudinal axis 612 of the frame 307, is constant between second end 610 and the junction 508. In an alternative embodiment, the width of the protruding segment 506*a* increases, along the longitudinal axis 612 of the frame 307, between the first end of the protruding segment 506*a* and the junction 508 (between the print station proximal portion 502 and the print station distal portion 504). In an alternative embodiment, the width of the protruding segment 506*a*, along the longitudinal axis 612 of the frame 307, increases for a predetermined length of the protruding segment 506*a*. Thereafter, the width of the protruding segment 506*a*, along the longitudinal axis 612 of the frame 307, remains constant for a remaining length of the protruding segment 506*a*. Such variation in the width of the protruding segment 506*a*, along the longitudinal axis 612 of the frame 307, facilitates in providing streamlined surface of the ribbon 120 traversal along the ribbon conveyance path 122.

Additionally, or alternatively, the width of the second end 610, along the longitudinal axis 612 of the frame 307, increase opposite to the ribbon conveyance path 122 towards the first end 608 of the protruding segment 506*a*. In yet another alternative embodiment, the width of the first end 608 and the second end 610 is same. In yet another embodiment, the width of the second end is less than a width of the first end, along the longitudinal axis 612 of the frame 307.

Additionally, or alternately, the protruding segment 506*a* may be inclined at a third predetermined angle, with respect to the median 602. In an example embodiment, the protruding segment 506*a* creates a positive angle with the median 602, as is measured from the median 602. A person having ordinary skills in the art would appreciate that the positive angle refers to an angle that is measured in an anti-clockwise direction from the media 602. In some examples, the third predetermined angle may vary in a range between +45 degrees and +60 degrees. In an example embodiment, other protruding segments 506*b*, 506*c*, and 506*d*, in the set of protruding segments 606*a*, are parallel to the protruding segment 506*a*. Accordingly, other protruding segments 506*b*, 506*c*, and 506*d*, are also inclined at the third predetermined angle, with respect to the median 602. To this end, the second end 610 of the protruding segments 506 in the set of protruding segments 606*a* are positioned distal from the median 602, and the first end 608 of the protruding segments 506 in the set of protruding segments 606*a* are positioned proximal from the median 602.

In some examples, the scope of the disclosure is not limited to the set of protruding segments 506 being parallel to each other. In an alternative embodiment, each protruding segment (e.g., 506*a*) in the set of protruding segments 506 may be inclined at a different predetermined angle with respect to the median 602. For example, the protruding segment 506*a* may be inclined at an angle of +45 degrees, while the protruding segment 506*b* may be inclined at an angle of +50 degrees.

In some examples, the scope of the disclosure is not limited to the protruding segments 506 extending contiguously between the first end 608 and the second end 610. In an example embodiment, the base surface 512 may define one or more protruding segments 506 between the first end 608 and the second end 610. In such an embodiment, multiple protruding segments 506 may be defined along an original length of the protruding segment 506 (i.e., a length between the original first end and the second end). Further, in such an embodiment, each protruding segment of the one or more protruding segments may have a first end and the second end.

Further in some examples, the scope of the disclosure is not limited to the protruding segments 506 having a straight-line profile between the first end 608 and the second end. In an example embodiment, the protruding segments 506 may have an arc profile between the first end 608 and the second end 610. In such an embodiment, the protruding segments 506 may be curved outwardly towards the second end 610.

FIG. 6C, illustrates a front view of the second lateral portion 604 of the ribbon support plate 404, according to one or more embodiments described herein. The second lateral portion 604 includes the set of protruding segments 606*b*. In an example embodiment, the set of protruding segments 606*b* are structurally similar to the set of protruding segments 606*a*. For example, each of the protruding segments 506 in the set of protruding segments 606*b* have the first end 608 and the second end 610. Further, each of the protruding segments 506 in the set of protruding segments 606*b* are inclined at a fourth predetermined angle with respect to the median 602. In an example embodiment, the each of the protruding segments 506 in the set of protruding segments 606*b* creates a negative angle with the median 602, as is measured from the median 602. A person having ordinary skills in the art would appreciate that the negative angle refers to an angle that is measured in a clockwise direction from the median 602. In some examples, the fourth predetermined angle may vary in a range between −45 degrees and −60 degrees. To this end, the second end 610 of the protruding segments 506 in the set of protruding segments 606*b* are positioned distal from the median 602, and the first end 608 of the protruding segments 506 in the set of protruding segments 606*b* are positioned proximal from the median 602.

In an example embodiment, the set of protruding segments 606*b* and the set of protruding segments 606*a* in conjunction define a V-shaped pattern on the ribbon support plate 404. Such V-shaped pattern causes the ribbon 120 to stretch outwardly, when the ribbon 120 traverses along the ribbon conveyance path 122. Accordingly, the wrinkles on the ribbon 120 are removed due to such outwardly stretching of the ribbon 120.

Additionally, or alternatively, since the print station proximal portion 502 is inclined at a positive angle with the vertical axis 410 of the frame 307, therefore, the height of the protruding segments 506 increases along the ribbon conveyance path 122 (towards the ribbon take-up spool 308). Such change in height of the protruding segments 506 facilitates streamline traversal of the ribbon 120 along the ribbon conveyance path 122. In an alternative embodiment, the height of the protruding segments 506 increases within the print station proximal portion 502 and remains constant within the print station distal portion 504. In an alternative embodiment, the height of the protruding segments 506 increases within the print station proximal portion 502 and decreases within the print station distal portion 504.

In some examples, the scope of the disclosure is not limited to the defining the pattern on the ribbon support plate 404. In an alternative embodiment, the V-shaped pattern may be defined on the surface 402 (defined on the frame 307). Further, in some examples, the scope of the disclosure is not limited to the ribbon support plate being molded with the frame 307. In an alternative embodiment, the ribbon support plate 404 may be retrofitted along the ribbon conveyance path 122. Such retrofitting allows to upgrade existing printers to enable the exiting printers to remove wrinkles from the ribbon 120.

In some examples, the scope of the disclosure is not limited to a count of protruded segments 506 illustrated in FIGS. 4-6. The ribbon support plate 404 may have any number of protruded segments 506, without departing from the scope of the disclosure.

In some example embodiments, certain ones of the operations herein may be modified or further amplified as described below. Moreover, in some embodiments additional optional operations may also be included. It should be appreciated that each of the modifications, optional additions or amplifications described herein may be included with the operations herein either alone or in combination with any others among the features described herein.

The foregoing method descriptions and the process flow diagrams are provided merely as illustrative examples and are not intended to require or imply that the steps of the various embodiments must be performed in the order presented. As will be appreciated by one of skill in the art the order of steps in the foregoing embodiments may be performed in any order. Words such as "thereafter," "then," "next," etc. are not intended to limit the order of the steps; these words are simply used to guide the reader through the description of the methods. Further, any reference to claim elements in the singular, for example, using the articles "a," "an" or "the" is not to be construed as limiting the element to the singular.

Many modifications and other embodiments of the inventions set forth herein will come to mind to one skilled in the art to which these inventions pertain having the benefit of teachings presented in the foregoing descriptions and the associated drawings. Although the figures only show certain components of the apparatus and systems described herein, it is understood that various other components may be used in conjunction with the supply management system. Therefore, it is to be understood that the inventions are not to be limited to the specific embodiments disclosed and that modifications and other embodiments are intended to be included within the scope of the appended claims. Moreover, the steps in the method described above may not necessarily occur in the order depicted in the accompanying diagrams, and in some cases one or more of the steps depicted may occur substantially simultaneously, or additional steps may be involved. Although specific terms are employed herein, they are used in a generic and descriptive sense only and not for purposes of limitation.

What is claimed is:

1. A printing apparatus, comprising:

a ribbon supply spool configured to facilitate traversal of ribbon along a ribbon conveyance path;

a ribbon take-up spool positioned downstream of the ribbon supply spool along the ribbon conveyance path configured to receive the ribbon after a printing operation;

a ribbon support plate positioned in the ribbon conveyance path between the ribbon supply spool and the ribbon take-up spindle;

wherein the ribbon support plate includes a plurality of protruding segments extending along the ribbon conveyance path, wherein the plurality of protruding segments facilitates stretching of the ribbon as the ribbon traverses along the ribbon conveyance path;

wherein the plurality of protruding segments includes a first set of projections and a second set of projections, wherein the first set of projections and the second set of projections extend outwardly from a median of the ribbon support plate to define a V-shaped pattern, and wherein projections in at least one of the first set of projections or the second set of projections are parallel with other projections in their respective set; and wherein the plurality of protruding segments extend outwardly along the ribbon conveyance path between a top edge of the ribbon support plate and a bottom edge of the ribbon support plate, wherein a height of the plurality of protruding segments increases as the plurality of protruding segments extend from the bottom edge towards the top edge.

2. The printing apparatus according to claim 1, wherein the plurality of protruding segments is defined at an angle, with respect to a median defined along a vertical axis of the printing apparatus, varying in a range between 40 degrees to 60 degrees.

3. The printing apparatus of claim 2, wherein each of the plurality of protruding segments comprises a first end and a second end, wherein a width of the first end, along a longitudinal axis, of the printing apparatus is less than a width of the second end, along the longitudinal axis of the printing apparatus.

4. The printing apparatus according to claim 1, wherein the ribbon support plate is within a housing of said printing apparatus.

5. The printing apparatus according to claim 4, wherein the ribbon support plate is molded with the housing of said printing apparatus.

6. The printing apparatus according to claim 5, wherein a print head assembly is positioned upstream of the ribbon support plate.

7. The printing apparatus according to claim 1, wherein the ribbon support plate further comprises a print station proximal portion and a print station distal portion, wherein the print station proximal portion is inclined at a predetermined angle with respect to a vertical axis of the printing apparatus, and wherein the print station distal portion creates a zero degree angle with the vertical axis.

8. The printing apparatus according to claim 1, wherein the plurality of protruding segments extends between a first end and a second end, and wherein the plurality of protruding segments has an arc profile.

9. The printing apparatus according to claim 1, wherein the plurality of protruding segments extends between a first end and a second end, and wherein the height of the plurality of protruding segments is greater at the second end than at the first end.

10. A ribbon support plate comprising:

a ribbon support plate configured to be positioned in a ribbon conveyance path between a ribbon supply spool and a ribbon take-up spool in the printing apparatus, wherein the ribbon support plate includes a plurality of protruding segments extending along the ribbon conveyance path, wherein the plurality of protruding segments are configured to facilitate stretching of the ribbon when the ribbon traverses along the ribbon conveyance path, wherein the plurality of protruding segments includes a first set of projections and a second set of projections, wherein the first set of projections and the second set of projections extend outwardly from a median of the ribbon support plate to define a V-shaped pattern, wherein projections in at least one of the first set of projections or the second set of projections are parallel with other projections in their respective set, and wherein the plurality of protruding segments extend outwardly along the ribbon conveyance path between a top edge of the ribbon support plate and a bottom edge of the ribbon support plate, wherein a height of the plurality of protruding segments increases as the plurality of protruding segments extend from the bottom edge towards the top edge.

11. The ribbon support plate of claim 10, wherein the plurality of protruding segments is defined at an angle, with respect to a median defined along a vertical axis of the printing apparatus, varying in a range between 40 degrees to 60 degrees.

12. The ribbon support plate of claim 11, wherein each of the plurality of protruding segments comprises a first end and a second end, wherein a width of the first end, along a longitudinal axis, of the printing apparatus is less than a width of the second end, along the longitudinal axis of the printing apparatus.

13. The ribbon support plate of claim 10, wherein the ribbon support plate is configured to be retrofitted to a housing of said printing apparatus.

14. The ribbon support plate according to claim 10, wherein the ribbon support plate further comprises a print station proximal portion and a print station distal portion, wherein the print station proximal portion is inclined at a predetermined angle with respect to a vertical axis of the printing apparatus, and wherein the print station distal portion creates a zero degree angle with the vertical axis.

15. The ribbon support plate according to claim 10, the plurality of protruding segments extends between a first end and a second end, and wherein the plurality of protruding segments has an arc profile.

16. The ribbon support plate according to claim 10, wherein the plurality of protruding segments extends between a first end and a second end, and wherein the height of the plurality of protruding segments is greater at the second end than the first end.

* * * * *